US010544788B2

(12) United States Patent
Duncan et al.

(10) Patent No.: US 10,544,788 B2
(45) Date of Patent: Jan. 28, 2020

(54) DUAL INTEGRATED PUMP HAVING A FIRST AND SECOND PUMP PORTION CONNECTED IN SERIES AND DRIVEN BY A COMMON SHAFT

(71) Applicant: CIRCOR PUMPS NORTH AMERICA, LLC, Monroe, NC (US)

(72) Inventors: Patrick Wilson Duncan, Marchville, NC (US); Philip Taylor Alexander, Matthews, NC (US); Charles Hinckley, Hardwick, MA (US)

(73) Assignee: CIRCOR PUMPS NORTH AMERICA, LLC, Monroe, NC (US)

( * ) Notice: Subject to any disclaimer, the term of this patent is extended or adjusted under 35 U.S.C. 154(b) by 187 days.

(21) Appl. No.: 15/326,128

(22) PCT Filed: May 20, 2015

(86) PCT No.: PCT/US2015/031774
§ 371 (c)(1),
(2) Date: Jan. 13, 2017

(87) PCT Pub. No.: WO2016/022193
PCT Pub. Date: Feb. 11, 2016

(65) Prior Publication Data

US 2017/0211577 A1 Jul. 27, 2017

Related U.S. Application Data

(60) Provisional application No. 62/032,848, filed on Aug. 4, 2014.

(51) Int. Cl.
*F04D 13/12* (2006.01)
*F04C 2/10* (2006.01)
(Continued)

(52) U.S. Cl.
CPC ..... *F04D 13/12* (2013.01); *F04C 2/101* (2013.01); *F04C 11/006* (2013.01); *F04C 14/02* (2013.01);
(Continued)

(58) Field of Classification Search
CPC ..... F04D 1/00; F04D 13/12; F04D 13/024; F04D 13/0646; F04D 13/14;
(Continued)

(56) References Cited

U.S. PATENT DOCUMENTS 1,927,799 A * 9/1933 Mann ..... F04B 23/08 417/203
3,026,929 A 3/1962 Burns et al.
(Continued)

FOREIGN PATENT DOCUMENTS

RU 2466299 C2 11/2012

OTHER PUBLICATIONS

International Search Report and Written Opinion dated Aug. 19, 2015 for corresponding PCT application PCT/US2015/031774 filed May 20, 2015.

*Primary Examiner* — Bryan M Lettman
*Assistant Examiner* — Timothy P Solak

(57) ABSTRACT

A pump includes a housing, a drive shaft, a centrifugal pump portion having an impeller, and a gear pump portion having first and second gears. The impeller and one of the first and second gears are mounted to the drive shaft to drive the centrifugal pump portion and the gear pump portion at the same rotational speed. The gear pump can be a crescent internal gear (CIG) pump. The drive shaft can be rotated by a magnetic drive. The drive shaft can include a longitudinal bore in fluid communication with a cavity in the magnetic drive and with a discharge of the centrifugal pump portion to circulate working fluid through the magnetic drive to cool
(Continued)

the drive. An impeller can be coupled to an inlet of the centrifugal pump portion.

16 Claims, 9 Drawing Sheets

(51) Int. Cl.

| | |
|---|---|
| ***F04C 11/00*** | (2006.01) |
| ***F04C 15/06*** | (2006.01) |
| ***F04D 13/02*** | (2006.01) |
| ***F04D 29/58*** | (2006.01) |
| ***F04D 1/00*** | (2006.01) |
| ***F04D 15/00*** | (2006.01) |
| ***F04D 29/00*** | (2006.01) |
| ***F04D 29/043*** | (2006.01) |
| ***F04C 14/02*** | (2006.01) |
| ***F04C 29/12*** | (2006.01) |
| ***F04C 14/08*** | (2006.01) |
| ***F04C 15/00*** | (2006.01) |
| ***F04C 29/00*** | (2006.01) |

(52) U.S. Cl.
CPC ..... *F04C 14/08* (2013.01); *F04C 15/0069* (2013.01); *F04C 15/062* (2013.01); *F04C 29/0064* (2013.01); *F04C 29/122* (2013.01); *F04D 1/00* (2013.01); *F04D 13/024* (2013.01); *F04D 15/0066* (2013.01); *F04D 29/007* (2013.01); *F04D 29/043* (2013.01); *F04D 29/586* (2013.01); *F04D 29/5806* (2013.01); *F04C 2240/603* (2013.01)

(58) Field of Classification Search
CPC .... F04D 29/586; F04D 29/007; F04D 29/043; F04D 29/445; F04D 29/669; F04C 2/08; F04C 2/101; F04C 11/006; F04C 13/00; F04C 13/001; F04C 14/02; F04C 14/08; F04C 15/062; F04C 15/0069; F04C 15/0096; F04C 29/0064; F04C 29/122; F04C 2240/603; F04C 2270/42
See application file for complete search history.

(56) References Cited

U.S. PATENT DOCUMENTS

| | | | | | |
|---|---|---|---|---|---|
| 3,105,441 | A | | 10/1963 | Grill et al. | |
| 3,635,602 | A | * | 1/1972 | Grennan | F04C 11/006 417/201 |
| 3,817,653 | A | * | 6/1974 | Onal | F04D 13/14 415/143 |
| 4,013,384 | A | * | 3/1977 | Oikawa | F04D 3/02 415/10 |
| 4,042,351 | A | * | 8/1977 | Anderson | B01D 19/0057 95/248 |
| 5,322,421 | A | * | 6/1994 | Hansen | F04C 15/0096 417/410.1 |
| 5,360,325 | A | * | 11/1994 | Henry, IV | F04C 2/101 418/126 |
| 2011/0314830 | A1 | * | 12/2011 | Legare | F01D 25/20 60/772 |
| 2013/0320147 | A1 | * | 12/2013 | Lewis | F04C 2/18 244/135 R |

* cited by examiner

DUAL INTEGRATED PUMP HAVING A FIRST AND SECOND PUMP PORTION CONNECTED IN SERIES AND DRIVEN BY A COMMON SHAFT

CROSS-REFERENCE TO RELATED APPLICATIONS

The present application claims is a non-provisional of Provisional U.S. Pat. App. No. 62/032,848 by Duncan et al., titled "Dual Integrated Organic Working Fluid Pump," filed on Aug. 4, 2014, the entirety of which is incorporated by reference herein.

FIELD OF THE DISCLOSURE

The disclosure generally relates to positive displacement pumps, and more particularly to an improved suction booster arrangement for a crescent internal gear pump.

BACKGROUND OF THE DISCLOSURE

When pumping fluids with high vapor pressure, particularly refrigerants in Organic Rankine Cycles and refrigeration cycles, CIG (Crescent Internal Gear) pumps can have issues with cavitation caused by insufficient inlet pressure. In order to meet pumping performance requirements these CIG pumps are often limited in speed or the height of fluid the CIG pump can lift. One solution is to boost the inlet pressure to the CIG pump so that it can operate without cavitation. Commonly, the entire system has to be designed around the position of the CIG pump to protect against such cavitation conditions. Often it is required that a second standalone pump be mounted low in the system to provide a low pressure boost to the CIG pump inlet.

Sealing refrigerants against escape to the surroundings is a key environmental and operational concern. Traditional mechanical seals and lip seals often are unreliable given the small amount of leakage that is allowed by governing agencies. A common solution to such sealing issues is to use a magnetic drive, which eliminates the need for a seal between the drive shaft and the pump casing. Magnetic drives operating at high speeds, however, come with another disadvantage, namely heat. Heat is generated when using magnetic drives, and as this heat builds the drive becomes less efficient. In some cases the heat generated by the drive offsets the advantage of the drive and can cause it to fail.

In addition, when pumps are used to boost inlet pressure to a CIG pump, the boost pumps are provided as completely separate pump systems, including piping/tubing, fittings and the like. Further, where boost pumps are employed it is important to ensure that sufficient inlet pressure is provided to the boost pump to prevent cavitation and damage to the boost pump.

If a separate boost pump is not employed then the system must be designed so that the CIG pump is located at the lowest point in the system in order to maximize inlet pressure. Often this is not enough, rendering the CIG pump insufficient for the application.

SUMMARY OF THE DISCLOSURE

In view of the deficiencies in the art, it would be desirable to provide a centrifugal pump to feed a CIG pump where the pumping elements of the two pumps are disposed on a common shaft. In the disclosed arrangement the impellers are designed such that inlet pressure drop is minuscule, thus making the product less prone to cavitation at the inlet to the impeller.

Thus, the disclosure represents an improved arrangement for efficiently boosting inlet pressure to a CIG pump, particularly when the CIG pump is used for pumping organic working fluids.

The disclosed pump may include an integrated centrifugal pump portion and a CIG pump portion that have a common drive shaft, housing and port. The centrifugal pump portion may boost the inlet pressure for the CIG pump portion. The pump can be configured to be used with refrigerants, but it can find application in pumping any of a variety of fluids as will be appreciated by one of ordinary skill in the art. The combination of two pumping elements on a single shaft can reduce the overall cost of having two separate pumps. It can also reduce unnecessary lines losses and efficiencies. Since both pumps' speed control can be on a common shaft, the output of the centrifugal pump portion is automatically adjusted to supply precisely the desired boost pressure to the CIG portion, rather than providing too much unnecessary pressure as is found in prior systems. This improves system efficiency and reduces power required to the system.

There are several advantages in the disclosed design as compared to prior systems in which a separate pump system is employed to provide boosted inlet pressure for a CIG pump. First, the integrated pump can be much smaller and more compact, taking up less footprint and fewer parts. The integrated pump can be cheaper than providing two separate pump systems. The integrated pump can be more efficient than two separate pump systems and can be more robust than two separate pump systems. In addition, the combination of two pumping elements on a single shaft reduces overall cost of having two separate pumps. This also reduces unnecessary lines losses and efficiencies. Since speed control for both pumps is on a common shaft, the centrifugal pump portion is automatically adjustable to supply precisely the desired boost pressure to the CIG pump portion inlet rather than providing too much unnecessary pressure. This improves system efficiency and reduces power required to the system.

It will be appreciated that although the description will proceed in relation to a centrifugal pump portion boosting pressure to the inlet of a CIG pump portion, that the disclosed pump can include a centrifugal pump portion in combination with other types of positive displacement pumps, including, but not limited to, internal gear pumps, external gear pumps and screw pumps.

Cooling of the magnetic coupling may be achieved by heat transfer to the working fluid flowing through the pump. This prevents overheating of the drive coupling while providing a leak free system.

The integrated pump can also be used to handle fluids besides refrigerants. The pump can be used to handle fuel oils, alcohol, lube oils, and other similar fluids. The pump can accommodate fluids for which the inlet pressure to the CIG pump alone is insufficient to fill the pump, thus causing cavitation. This concept may also be applied to pumping more viscous fluids. As viscosity increases, typically the operating speed of gear pumps have to be decreased. This is because the fluid may not flow quickly enough into the gear set to properly fill the gear pump. The disclosed design may allow the pump to pump much more viscous product without having to reduce the pump speed, and thus smaller pumps could be used to move same amount of flow as a larger common pump.

A pump is disclosed, including a housing to enclose at least a first pump portion and a second pump portion. The first pump portion and the second pump portion can be coupled to a common drive shaft. The first pump portion, upon rotation of the common drive shaft, can cause a first fluid pressure to change to a second fluid pressure with a fluid discharge at the second fluid pressure. The second pump portion, upon rotation of the common drive shaft, can cause the second fluid pressure to change to a third fluid pressure. The second pump portion can have a fluid inlet and the fluid inlet can be at the second fluid pressure and in fluid communication with the fluid discharge of the first pump portion.

A method is disclosed for controlling an inlet pressure of a pump, the method including rotating a drive shaft coupled to a first pump portion and a second pump portion, wherein the first pump portion and the second pump portion are enclosed in a common housing. Moving a fluid through the first pump portion and the second pump portion. The fluid can enter the first pump portion at a first fluid pressure and exit the first pump portion at a second fluid pressure. The fluid can enter the second pump portion at the second fluid pressure and exit the second pump portion at a third fluid pressure.

BRIEF DESCRIPTION OF THE DRAWINGS

By way of example, a specific embodiment of the disclosed device will now be described, with reference to the accompanying drawings.

DETAILED DESCRIPTION

Figure 1:
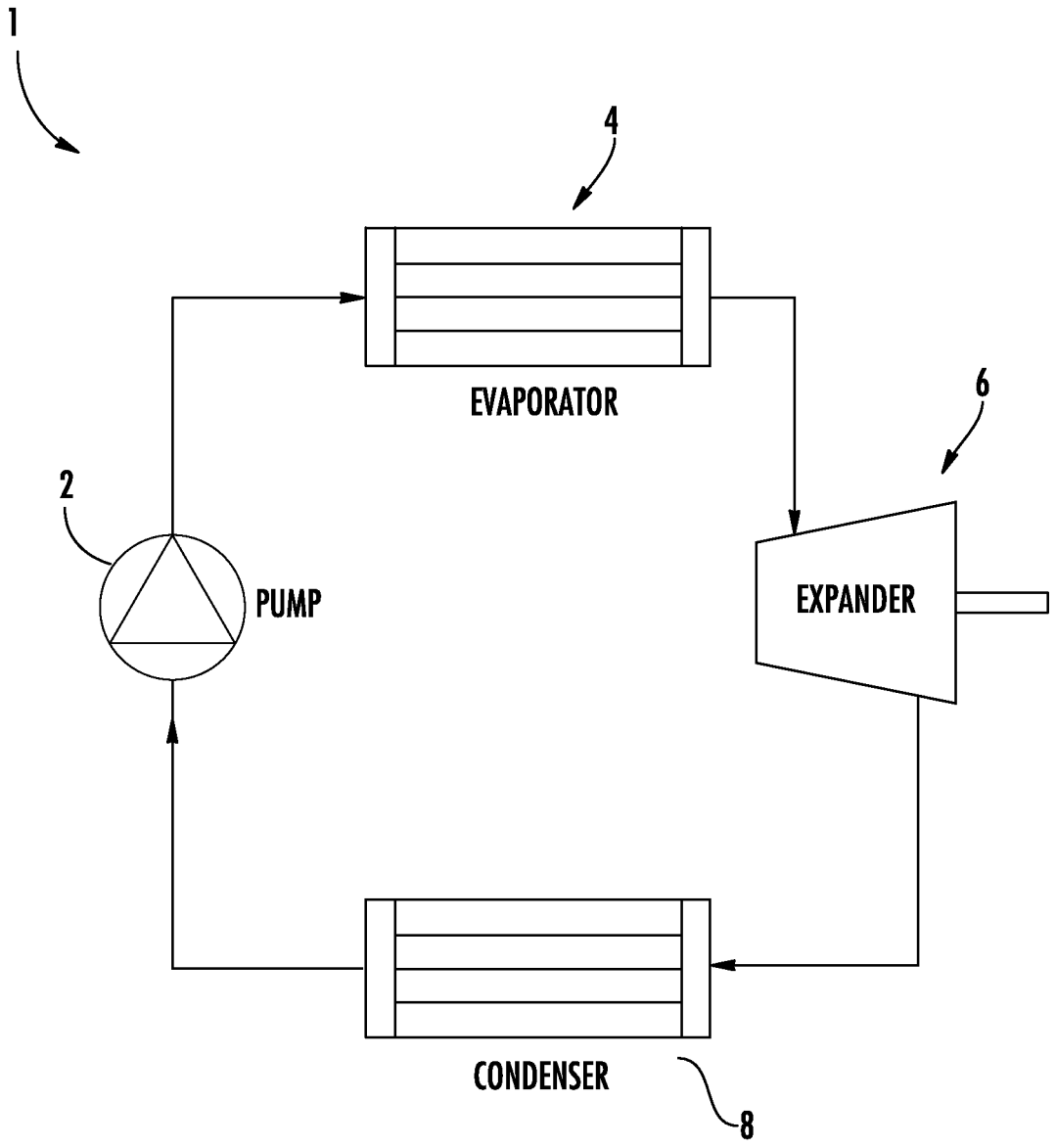
FIG. 1 is a diagram of an exemplary organic Rankine Cycle illustrating the position of the disclosed pump.

A pump is disclosed that incorporates a centrifugal boosting element and a CIG pump on a common shaft and within a common housing. The discharge passage for the centrifugal pumping element is common with the inlet passage for the CIG pump. The centrifugal element is configured so that pressure drop at the inlet to the centrifugal pump portion is minimal, thus reducing likelihood of cavitation of that portion. This provides a system designer with increased flexibility in determining where the unit can be mounted in the system and does not require the system designer to mount the CIG pump at the lowest point in the system. The fact that both pumping elements (i.e., centrifugal and CIG) are mounted on a common shaft reduces inefficiencies experienced with prior systems which use separate drivers for each pump. It also eliminates critical line losses associated with piping and piping bends between the boost pump and the CIG pump. Further, the common drive shaft provides an automatically adjustable boost pressure to the CIG pump. That is, as the speed of the CIG pump increases, the speed of the boost pump also increases, and thus minimal energy is wasted building pressure that is not necessary. These efficiency and energy savings are an important factor in every organic pumping system since the primary purpose of these systems is to recuperate wasted energy and return it as usable energy.

In general, the working fluid enters a centrifugal pump portion 16 of the pump 2 (see, e.g., FIG. 4) at a pressure that is too low for the CIG pump portion 14 (i.e., there is a significant pressure drop at the inlet portion to a CIG pump portion required to fill the gear set with fluid). As the fluid passes through the centrifugal pump portion 16, however, the pressure is increased. This pressurized fluid then passes through the discharge 32 of the centrifugal pump portion 16 to the inlet 34 of the CIG pump portion 14. The pressure at the CIG pump portion 14 inlet 34 is now above the NIPR (Net Inlet Pressure Required) so the CIG pump portion 14 will not cavitate. The fluid exits the pump 2 at the CIG pump portion 14 discharge port 50 at flow and pressure required by the system 1. As the CIG pump portion 14 speed increases, the demand for higher inlet pressure for the CIG pump portion increases. Since the centrifugal pump portion 16 is on the same drive shaft 22 as the CIG pump portion 14, its speed also increases, which in turn increases the discharge pressure and flow of the centrifugal pump portion. In this way, output of the centrifugal pump portion 16 keeps up with the demands of inlet for the CIG pump portion 14.

It will be appreciated that although the description will proceed in relation to a centrifugal pump portion 16 boosting pressure to the inlet of a CIG pump portion 14, that the disclosed pump 2 can include a centrifugal pump portion in combination with other types of positive displacement pumps, including, but not limited to, internal gear pumps, external gear pumps and screw pumps.

Referring now to FIG. 1, a schematic of an exemplary organic Rankine Cycle 1 shows the position of the disclosed pump 2 in the context of an evaporator 4, an expander 6 and a condenser 8. It will be appreciated that although the pump 2 is shown in the context of an organic Rankine Cycle, its use is not so limited, and thus the pump may find application in any of a variety of other applications. In the illustrated embodiment, the pump 2 is shown providing pressurized working fluid to the evaporator 4, which evaporates the working fluid and provides it to the expander 6. The working fluid passes from the expander 6 to a condenser 8 where it is condensed and provided to the inlet of the pump 2.

Figure 2:
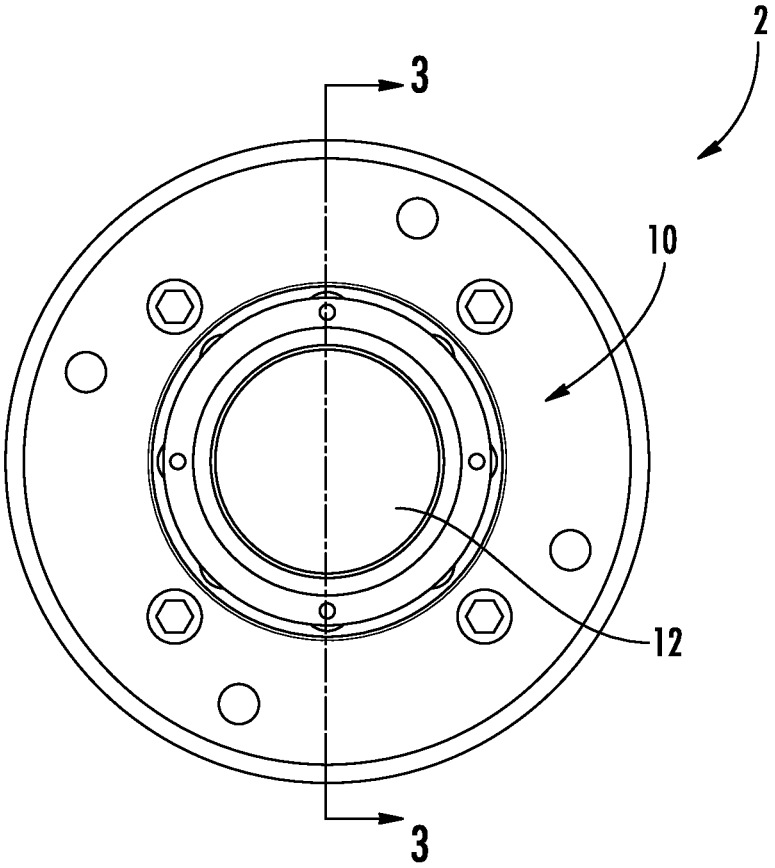
FIG. 2 is an end view of a pump according to an exemplary embodiment of the disclosure.
Figure 3:
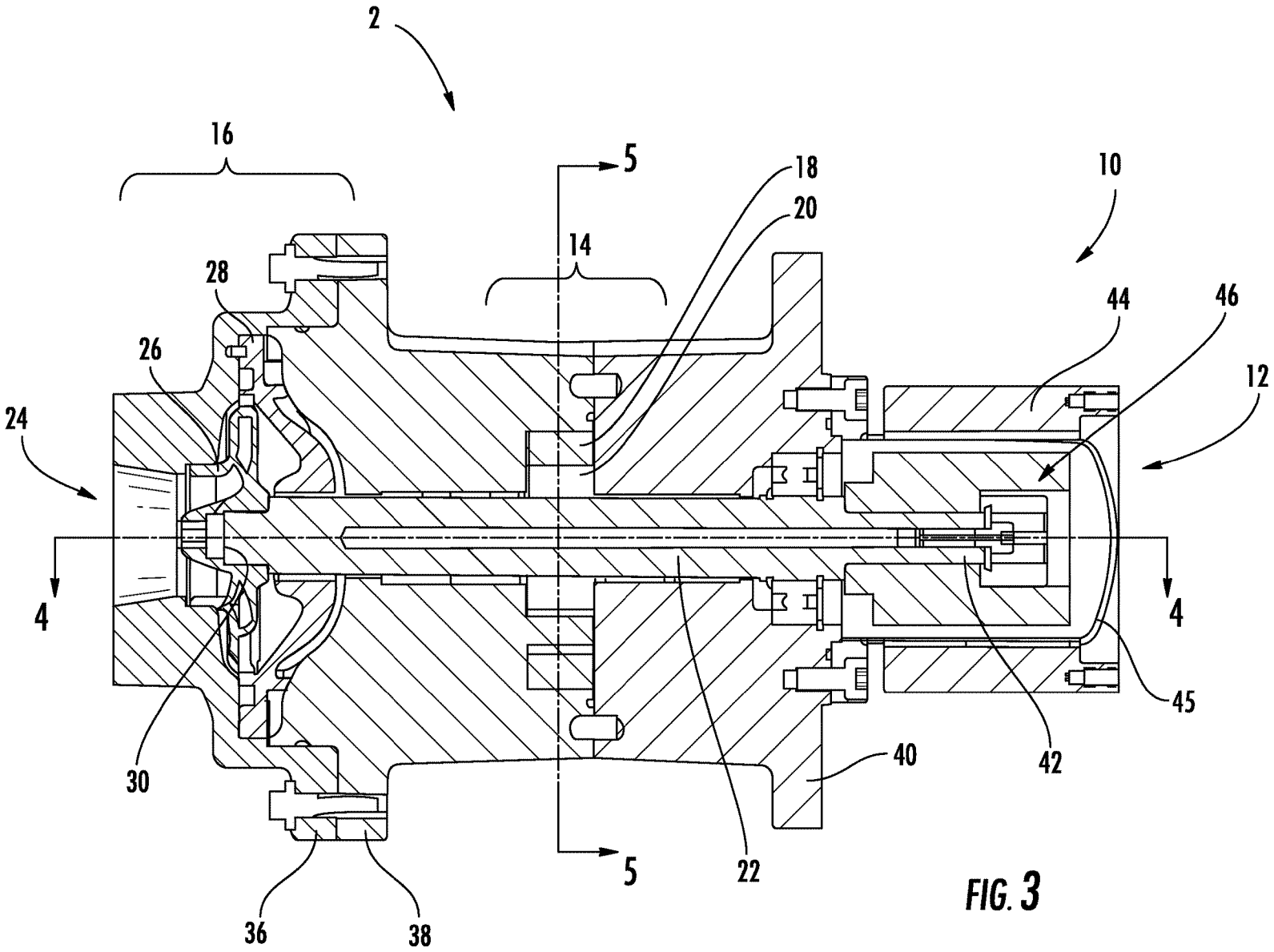
FIG. 3 is a cross-section view of the pump of FIG. 2, taken alone line 3-3 of FIG. 2.
Figure 4:
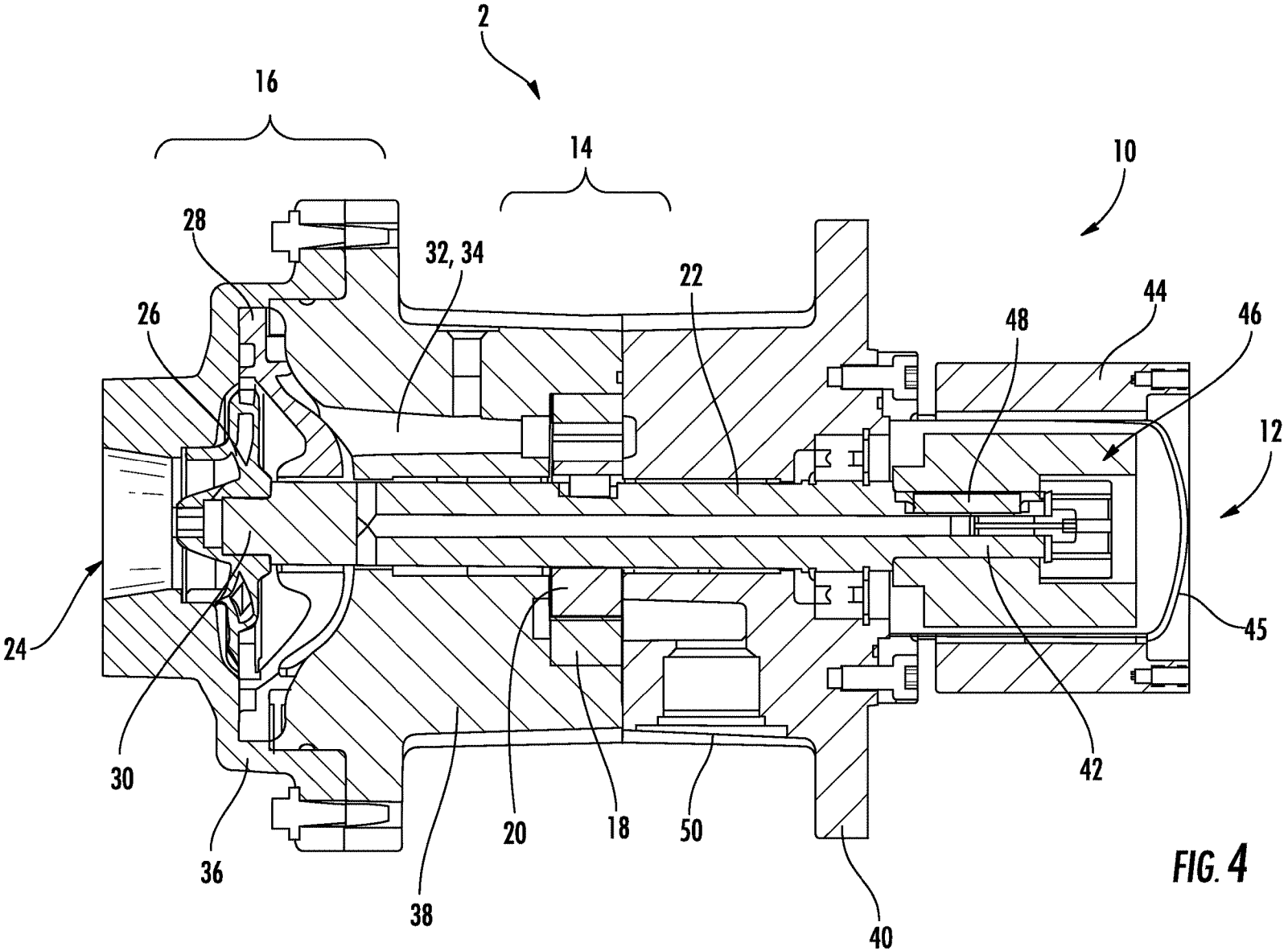
FIG. 4 is a cross-section view of the pump of FIG. 2, taken alone line 4-4 of FIG. 3.

FIG. 2 is an end view of the disclosed pump 2 showing a first end 10 of the pump. A magnetic coupling portion 12 is positioned on the first end 10 to provide rotational motion to the pump 2 as will be described in greater detail later. FIGS. 3 and 4 are cross-sectional views of the pump 2 illustrating the relative positioning of the magnetic coupling portion 12, CIG pump portion 14 and centrifugal pump portion 16. The CIG pump portion 14 comprises first and second gears 18, 20. The second gear 20 is mounted to a drive shaft 22 so that the drive shaft can rotate the second gear 20 at a desired rotational rate. The second gear 20 intermeshes with the first gear 18 to pump working fluid in a manner understood to one of ordinary skill in the art. The centrifugal pump portion 16 includes an inlet 24, an impeller 26 and a diffuser 28. The impeller 26 is coupled to a first end 30 of the drive shaft 22 so that the drive shaft can rotate the impeller at the same rate as the second gear 20 of the CIG pump portion 14.

As can be seen, a discharge 32 of the centrifugal pump portion 16 is coexistent with the inlet 34 of the CIG pump portion 14, which minimizes losses between the pump portions as will be understood.

The pump 2 includes first, second and third casing portions 36, 38, 40 which, when connected together result in a unitary pump casing. The first casing portion 36 and the second casing portion 38, when coupled, house the impeller 26 and the diffuser 28 of the centrifugal pump portion 16. It will be appreciated that although a diffuser is shown, it is not necessary, and in some embodiments the centrifugal pump portion 16 could include a volute instead of a diffuser. The second casing portion 38 and the third casing portion 40, when coupled, house the first and second gears 18, 20 of the CIG pump portion 14. The magnetic coupling portion 12 can be mounted to the third casing portion, and the drive shaft 22 can extend from the magnetic coupling portion through the first, second and third casing portions 38, 40. Although the illustrated embodiment shows three discrete casing portions, it will be appreciated that other casing arrangements can be employed. In addition, although the illustrated embodiment shows the casing portions coupled by threaded fasteners (bolts, cap screws, etc.) it will be appreciated that the portions can be connected by any appropriate technique.

The magnetic coupling portion 12 may include an outer portion 44, a can portion 45, and an inner portion 46. In the illustrated embodiment the inner portion 46 is coupled to a second end 42 of the drive shaft 22 and is operable to rotate the drive shaft at a desired rate. It will be appreciated that although the motor is being described as comprising a magnetic drive, this is not critical and other motor types can be used without departing from the spirit of the disclosure. In the illustrated embodiment the inner portion 46 of the magnetic coupling portion 12 is rotationally connected to the second end 42 of the drive shaft via a key/keyway arrangement 48 (FIG. 4). Thus arranged, as the motor rotates the magnetic coupling portion 12, which rotates the drive shaft 22, the second gear 20 and the impeller 26 rotate to pump fluid from the inlet 24 of the centrifugal pump portion 16 to a discharge 50 (FIG. 4) of the CIG pump portion 16.

Figure 5:
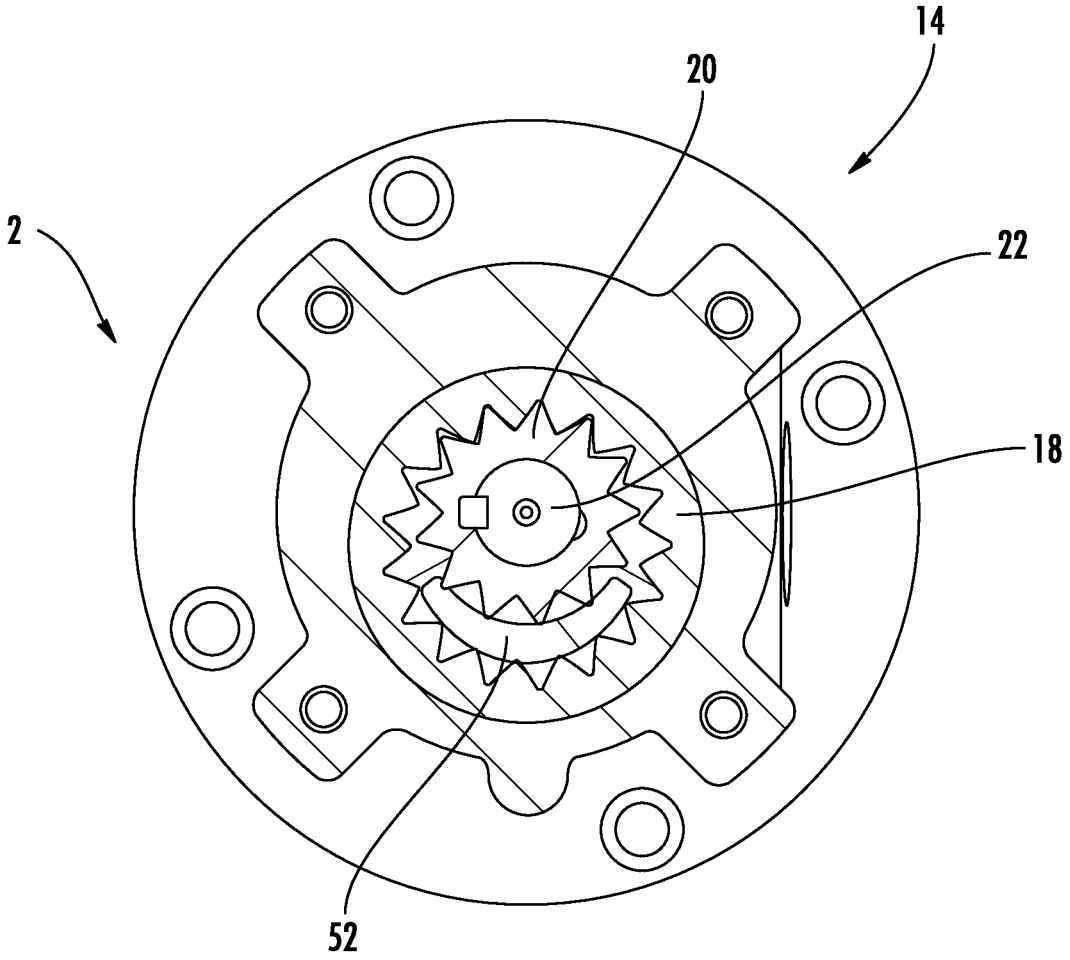
FIG. 5 is a cross-section view of the pump of FIG. 2, taken alone line 5-5 of FIG. 3.

FIG. 5 illustrates an exemplary gearing arrangement for the CIG pump portion 14. As can be seen, the first gear 18 comprises a ring gear element while the second gear 20 is coupled to the drive shaft 22. A crescent element 52 is positioned between the first and second gears 18, 20. As the drive shaft 22 and second gear 20 rotate, working fluid is drawn from the CIG pump portion inlet 34 and pumped to the discharge 50 (FIG. 4).

Figure 6:
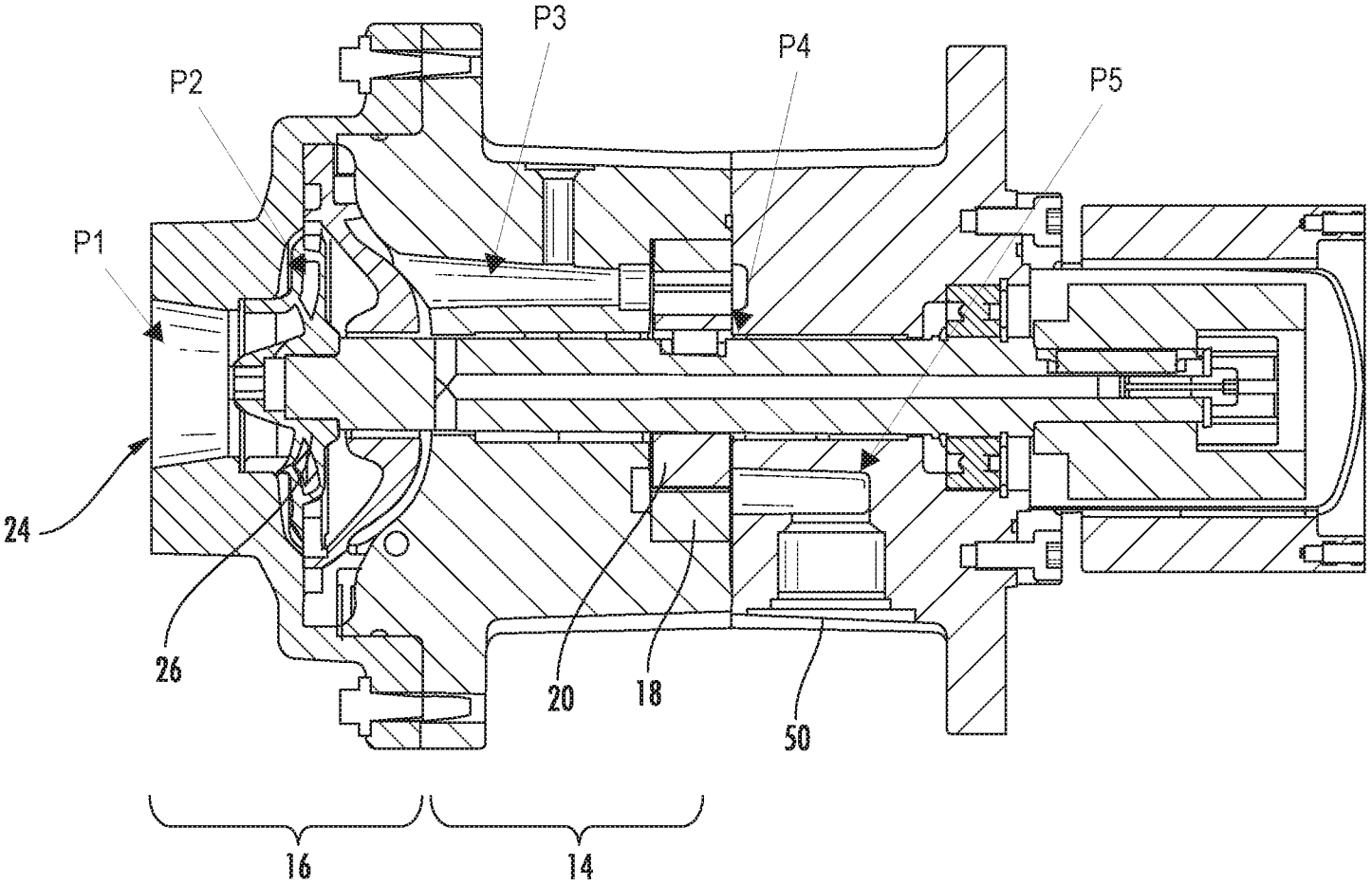
FIG. 6 is a cross-section view of the pump of FIG. 2 illustrating exemplary pressure zones within the pump.
Figure 7:
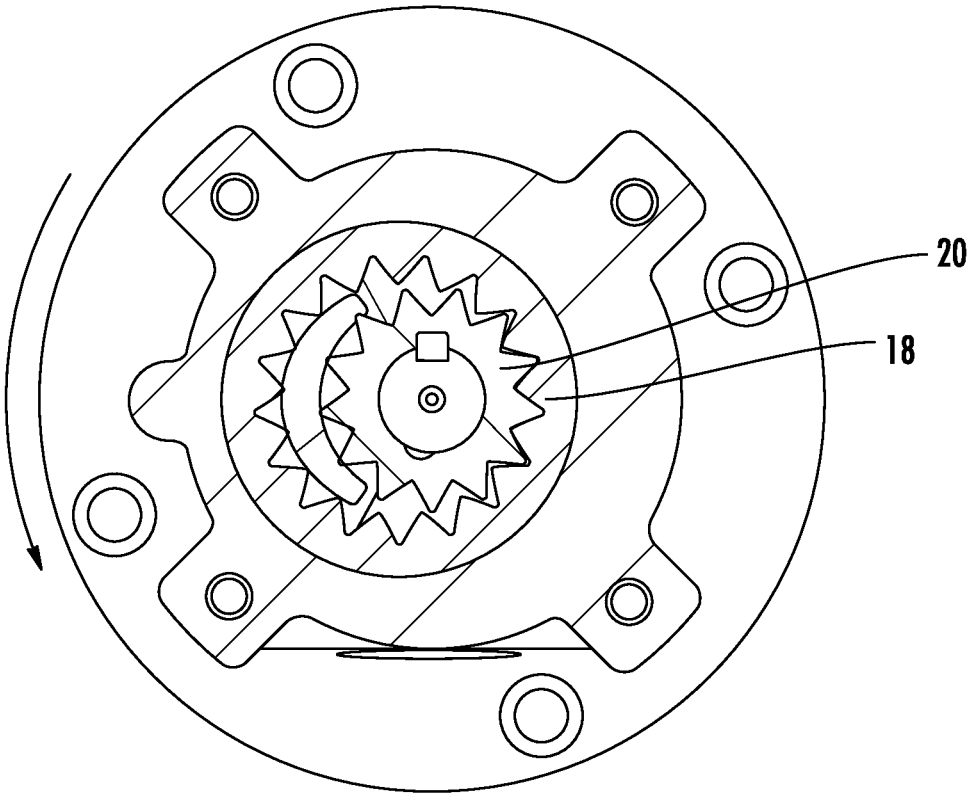
FIG. 7 is a cross-section view of the pump of FIG. 2, illustrating exemplary discharge flows and pressures within the CIG portion of the pump.

Referring now to FIGS. 6 and 7, a description of flow within the pump 2 during operation, along with a discussion of the different pressure zones of the pump, will be provided. At the inlet 24 of the centrifugal pump portion 16, the inlet pressure is indicated as "P1," which is substantially the pressure of the working fluid received from the condenser 8 (FIG. 1) minus line losses between the two components. Fluid pressure "P2" indicates an increasing pressure across the centrifugal pump portion 16, e.g., rising across the impeller 26, reaching pressure "P3," as centrifugal discharge pressure and CIG inlet pressure, in the discharge 32 of the centrifugal pump portion 16 and the inlet 34 of the CIG pump portion 14. Between the first and second gears 18, 20 of the CIG pump portion 14 fluid pressure "P4" continues to rise to full discharge pressure "P5" at the discharge 50 of the CIG pump portion 14. The fluid pressure "P4" may be intermediate pressure that is greater than the fluid pressure "P3" but less than the full discharge pressure "P5," e.g., so that the pressure zones may be "P5">"P4">"P3">"P2">"P1". This discharge pressure "P5" is substantially the pressure of the working fluid provided to the evaporator 4 (FIG. 1), minus any line losses between the pump 2 and the evaporator.

Figure 8:
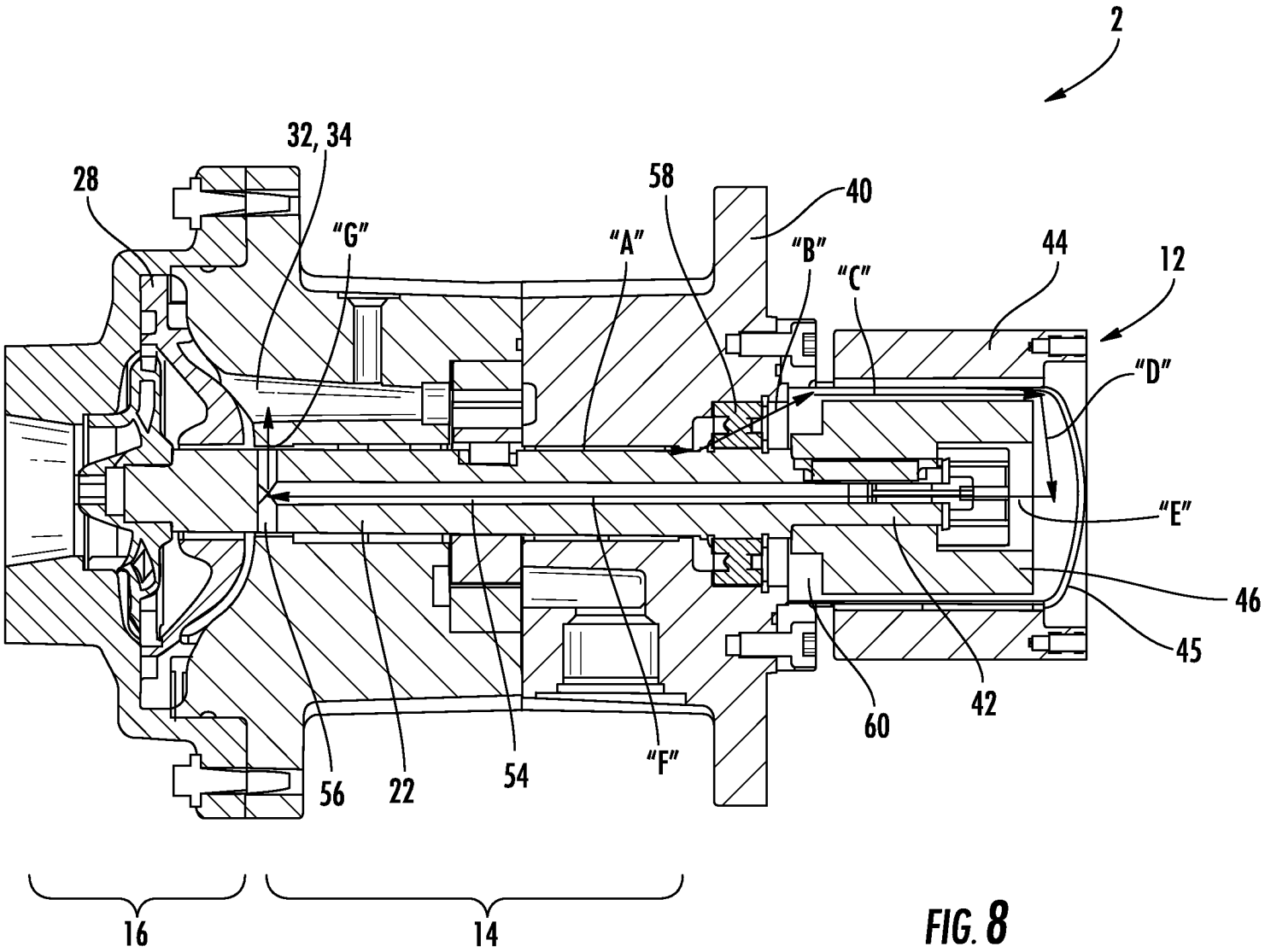
FIG. 8 is a cross-section view of the pump of FIG. 2 illustrating exemplary flow paths through the magnetic coupling.

FIG. 8 shows an exemplary cooling arrangement through the magnetic coupling portion 12 of the pump 2. As previously noted, magnetic drives can suffer from problems due to the generation of excess heat, which can affect their efficiency. To combat this, the disclosed pump 2 includes a cooling arrangement that operates to cool the magnetic coupling portion, thereby retaining a desired efficiency of the motor.

Cooling of the magnetic coupling portion 12 is achieved by heat transfer to the working fluid flowing through the pump 2. Flow is created due to a pressure differential on opposite sides of the can portion 45. High pressure enters the can portion 45 as it bleeds through the bearings 58 in the front of the CIG pump portion 14. This fluid then flows around the inner portion 46 of the magnetic coupling portion 12, absorbing heat from the components, and then flows back to the discharge 32 of the centrifugal pump portion 16 through bores in the drive shaft.

FIG. 8 shows the second end 42 of the drive shaft 22 is received within the inner portion 46 of the magnetic coupling portion 12. The drive shaft 22 includes a longitudinal bore 54 running from the second end 42 of the drive shaft to a position just short of the diffuser 28. A radial bore 56 is provided in the drive shaft 22 at this position such that the radial bore and the longitudinal bore 54 are connected. The radial bore 56 can be in fluid communication with the discharge 32 of the centrifugal pump portion 16.

In operation, working fluid flows from the CIG pump portion 14 between the drive shaft 22 and the third casing portion 40 (identified by arrow "A.") The working fluid then flows in the direction of arrow "B," across the shaft bearing 58 to a cavity 60 formed between the magnetic coupling portion 12 and the third casing portion 40. The fluid then flows between the can portion 45 and the inner portion 46 of the magnetic coupling portion 12 (identified by arrows "C" and "D,") whereupon it enters the longitudinal bore 54 at the second end 42 of the drive shaft 22 (at arrow "E.") It then flows through the longitudinal bore (arrow "F,") and enters the radial bore 56, flowing therein (arrow "G") until it joins with the discharge 32 of the centrifugal pump portion 16. Circulation of working fluid through this cooling path is motivated by the pressure differentials between different portions of the path. For example, relatively high pressure "P4" at the intermediate stage of the CIG pump portion 14 causes the working fluid to flow through the cooling path to the relatively lower pressure "P3" at the discharge 32 of the centrifugal pump portion 16.

As will be appreciated, this circulatory flow provides cooling of the magnetic coupling portion 12. By keeping relatively cool fluid continuously moving across the surfaces of the magnetic coupling portion 12, heat can be removed, allowing the magnetic coupling portion 12 to run cool continuously, and regardless of speed and load.

Figure 10:
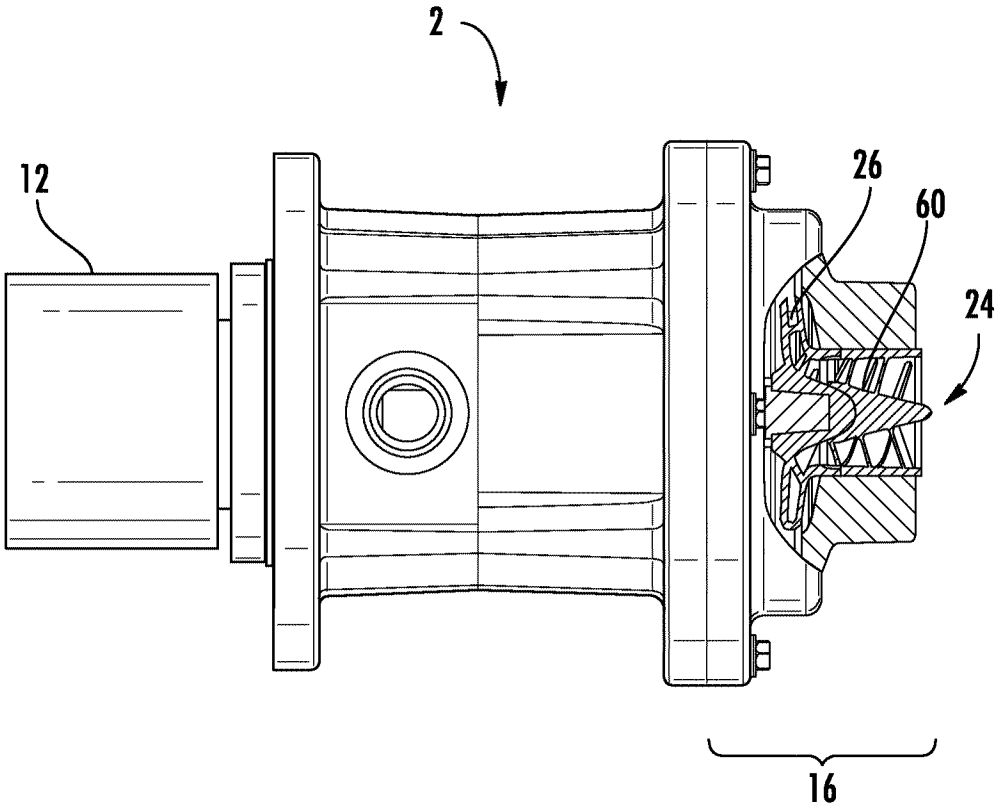
FIG. 10 is a cross-section view of the pump of FIG. 9, taken along line 10-10 of FIG. 9.
Figure 9:
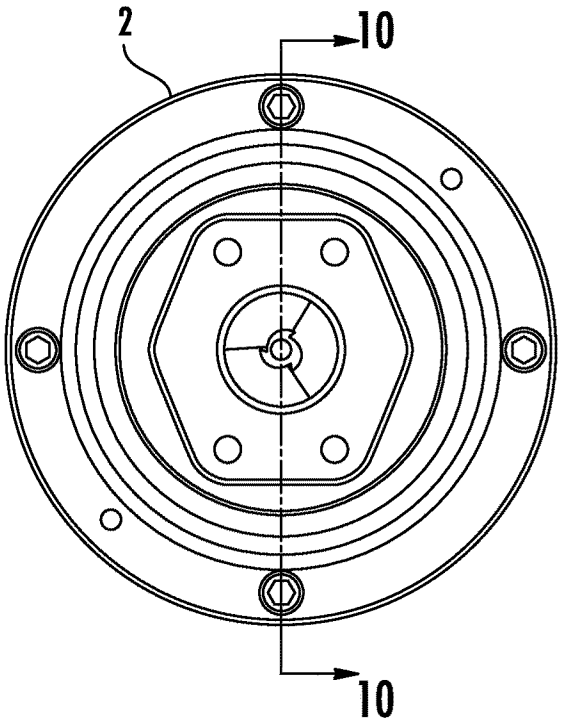
FIG. 9 is an end view of a pump according to another aspect of the disclosure.

FIGS. 9 and 10 illustrate an embodiment of the disclosed pump 2 that includes an inducer 60 coupled to the inlet 24 of the centrifugal pump portion 16. Adding an inducer to the suction region of the impeller 26 on the centrifugal pump portion 16 can enable the pump 2 to handle increasingly strenuous operating conditions where inlet pressure is pushing the limits of the centrifugal pump portion 16 alone.

Adding an inducer 60 can increase the fluid pressure at the eye of the impeller 26, thus filling the impeller inlet cavity quicker and reducing the chance for cavitation of the centrifugal pump portion 16.

This option may be employed in applications in which the inlet pressure to the pump 2 is below a required inlet pressure for the centrifugal pump portion 16. In such applications, if an inducer impeller were not used, the centrifugal pump portion 16 could cavitate.

Based on the foregoing information, it will be readily understood by those persons skilled in the art that the invention is susceptible of broad utility and application. Many embodiments and adaptations of the invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the invention or otherwise exclude any such other embodiments, adaptations, variations, modifications or equivalent arrangements; the invention being limited only by the claims appended hereto and the equivalents thereof. Although specific terms are employed herein, they are used in a generic and descriptive sense only and not for the purpose of limitation.

What is claimed is:

1. A pump comprising:

a housing to enclose at least a first pump portion and a second pump portion, wherein the first pump portion and the second pump portion are coupled to a common drive shaft, the common drive shaft additionally coupled to a magnetic coupling portion of a magnetic drive;

the first pump portion, upon rotation of the common drive shaft, to cause a first fluid pressure to change to a second fluid pressure, the first pump portion including a fluid discharge, wherein the fluid discharge is at the second fluid pressure; and the second pump portion, upon rotation of the common drive shaft, to cause the second fluid pressure to change to a third fluid pressure, the second pump portion including a fluid inlet, wherein the fluid inlet is in direct fluid communication with the fluid discharge of first pump portion; and wherein the common drive shaft includes a longitudinal bore, one end of the longitudinal bore in fluid communication with a cavity in the magnetic coupling portion, wherein a radial bore intersects, and is in fluid communication with, another end of the longitudinal bore and is further in fluid communication with the fluid discharge of the first pump portion; and wherein a pressure differential between the fluid discharge of the first pump portion and an intermediate stage of the second pump portion causes a working fluid to circulate through the longitudinal bore and the cavity in the magnetic coupling portion to remove heat from the magnetic drive via the working fluid.

2. The pump of claim 1, wherein the second fluid pressure is determined by the rotational speed of the second pump portion.

3. The pump of claim 1, wherein the second fluid pressure is at or above a net inlet pressure required (NIPR) of the second pump portion.

4. The pump of claim 1, wherein the fluid discharge of the first pump portion is coextensive with the fluid inlet of the second pump portion.

5. The pump of claim 1, wherein the first pump portion comprises a centrifugal pump portion.

6. The pump of claim 5, wherein the second pump portion comprises a gear pump portion.

7. The pump of claim 6, the housing comprising first, second and third casing portions, the first and second casing portions housing the centrifugal pump portion, the second and third casing portions housing the gear pump portion.

8. The pump of claim 6, wherein the centrifugal pump portion comprises a boost pump for the gear pump portion.

9. The pump of claim 6, wherein the centrifugal pump portion provides an increasing inlet pressure to the gear pump portion as a rotational speed of the drive shaft increases.

10. The pump of claim 1, the first pump portion comprising a centrifugal pump portion, the pump further comprising an inducer coupled to an inlet centrifugal pump portion to increase fluid pressure at an eye of an impeller of the centrifugal pump portion.

11. A method for controlling an inlet pressure of a pump, the method comprising:

rotating a drive shaft coupled to a first pump portion and a second pump portion, wherein the first pump portion and the second pump portion are enclosed in a common housing, the drive shaft additionally coupled to a magnetic coupling portion of a magnetic drive that drives the drive shaft; and moving a fluid through the first pump portion and the second pump portion, the fluid entering the first pump portion at a first fluid pressure and exiting the first pump portion at a second fluid pressure at a fluid discharge, the fluid entering the second pump portion at the second fluid pressure at a fluid inlet and exiting the second pump portion at a third fluid pressure;

wherein the fluid inlet of the second pump portion is in direct fluid communication with the fluid discharge of the first pump;

wherein the drive shaft includes a longitudinal bore, one end of the longitudinal bore in fluid communication with a cavity in the magnetic coupling portion, wherein a radial bore intersects, and is in fluid communication with, another end of the longitudinal bore and is further in fluid communication with the fluid discharge of the first pump portion; and wherein a pressure differential between the fluid discharge of the first pump portion and an intermediate stage of the second pump portion causes a working fluid to circulate through the longitudinal bore and the cavity in the magnetic coupling portion to remove heat from the magnetic drive via the working fluid.

12. The method of claim 11, comprising maintaining, through rotation of the drive shaft, the second fluid pressure at or above a net inlet pressure required (NIPR) of the second pump portion.

13. The method of claim 11, wherein altering a rotational speed of the common shaft changes the second fluid pressure and the third fluid pressure.

14. The method of claim 11, wherein the first pump portion is a centrifugal pump portion including an impeller.

15. The method of claim 11, wherein the second pump portion is a crescent internal gear pump portion.

16. The method of claim 11, wherein increasing a rotational speed of the drive shaft increases the second fluid pressure to prevent cavitation of the second pump portion.

* * * * *